US009221155B1

(12) United States Patent
Cantlon

(10) Patent No.: US 9,221,155 B1
(45) Date of Patent: Dec. 29, 2015

(54) LAG DRIVER

(75) Inventor: Nathan C. Cantlon, Charlo, MO (US)

(73) Assignee: Jore Corporation, Ronan, MT (US)

( * ) Notice: Subject to any disclaimer, the term of this patent is extended or adjusted under 35 U.S.C. 154(b) by 797 days.

(21) Appl. No.: 13/361,790

(22) Filed: Jan. 30, 2012

Related U.S. Application Data

(60) Provisional application No. 61/438,151, filed on Jan. 31, 2011.

(51) Int. Cl.
*B25B 13/02* (2006.01)
*B25B 13/06* (2006.01)
*B25B 23/06* (2006.01)

(52) U.S. Cl.
CPC ..... *B25B 13/06* (2013.01); *B25B 23/065* (2013.01)

(58) Field of Classification Search
CPC .. B25B 23/0057; B25B 23/065; B25B 13/06; B25B 31/202; B25B 31/1071; B25B 31/207
USPC ..... 81/119, 124.2, 901, 124.1, 125, 121.1, 81/64, 90.1, 90.3, 90.9; 279/90, 89, 93, 279/143, 144
See application file for complete search history.

(56) References Cited

U.S. PATENT DOCUMENTS 841,472 A * 1/1907 Vanderherchen ..... 81/125
1,418,184 A * 5/1922 Trunick ..... 279/93
4,029,135 A * 6/1977 Searfoss, Jr. ..... 227/113
4,724,731 A * 2/1988 Onofrio ..... 81/119
5,809,851 A * 9/1998 Thompson ..... 81/124.2
5,943,922 A * 8/1999 Rolfe ..... 81/124.2
6,626,068 B2 * 9/2003 McKivigan ..... 81/124.2
6,668,689 B1 * 12/2003 Lai ..... 81/451
6,711,974 B1 * 3/2004 Lin ..... 81/125
7,878,093 B1 * 2/2011 Peterman ..... 81/124.2
8,336,428 B2 * 12/2012 Johnson et al. ..... 81/60

OTHER PUBLICATIONS

"Craftsman Cup-Hook Eyelet Driver," Feb. 16, 2009, <http://www.sears.com/shc/s/p_10153_12605_00925754000P? . . . > [retrieved Dec. 6, 2010], 1 page.
"DeWalt DW2225 Acoustical Eye Lag Driver," <http://www.amazon.com/DeWalt-DW2225-Acoustical-Eye-Driver/dp/B00004H2V . . . > [retrieved Dec. 6, 2010], 2 pages.

* cited by examiner

*Primary Examiner* — Monica Carter
*Assistant Examiner* — Melanie Alexander
(74) *Attorney, Agent, or Firm* — Christensen O'Connor Johnson Kindness PLLC

(57) ABSTRACT

A lag driver includes a drive shank and a drive body assembly extending from the drive shank. The drive body assembly includes a fastener-receiving portion, wherein a fastener is receivable within the fastener-receiving portion in a first, loading position such that the fastener is positionable in substantial coaxial alignment with the lag driver, and wherein the fastener is rotatable into a second, locked position within the fastener-receiving portion such that the fastener-receiving portion is engageable with a portion of the fastener for applying torque to the fastener.

5 Claims, 3 Drawing Sheets

LAG DRIVER

CROSS-REFERENCE TO RELATED APPLICATION

This application claims the benefit of U.S. Provisional Patent Application No. 61/438,151, filed Jan. 31, 2011, the disclosure of which is hereby expressly incorporated by reference herein.

BACKGROUND

Hook and eye lag screws, as well as other similar types of fasteners (hereinafter collectively referred to as "hook and eye fasteners"), have numerous applications. For instance, a hook or eye fastener can mate with a latch or similar device to releasably secure a gate, door, etc., in a closed position. As another example, a hook or eye fastener can be used to hang an item, such as a coffee cup, a hanging plant, decorations, etc., from a surface (such as a ceiling, wall, cabinet, etc.). It can be appreciated that hook and eye fasteners have a wide range of use and can therefore be mounted in many different types of locations.

Hook and eye fasteners are normally installed manually since the hook or eye portion of the fastener is not engageable with a conventional drill chuck. The manual process is physically intensive since the hook and eye fasteners need to be securely mounted to the desired surface to adequately bear the load of the hanging item. The manual process also normally requires the use of a predrilled pilot hole to mount the fastener. Thus, without the use of a power drill, the process of installing a hook or eye fastener is tedious and time-consuming.

SUMMARY

A lag driver includes a drive shank and a drive body assembly extending from the drive shank. The drive body assembly includes a fastener-receiving portion, wherein a fastener is receivable within the fastener-receiving portion in a first, loading position such that the fastener is positionable in substantial coaxial alignment with the lag driver, and wherein the fastener is rotatable into a second, locked position within the fastener-receiving portion such that the fastener-receiving portion is engageable with a portion of the fastener for applying torque to the fastener.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of the present disclosure will become more readily appreciated by reference to the following detailed description, when taken in conjunction with the accompanying drawings, wherein.

DETAILED DESCRIPTION

Figure 1:
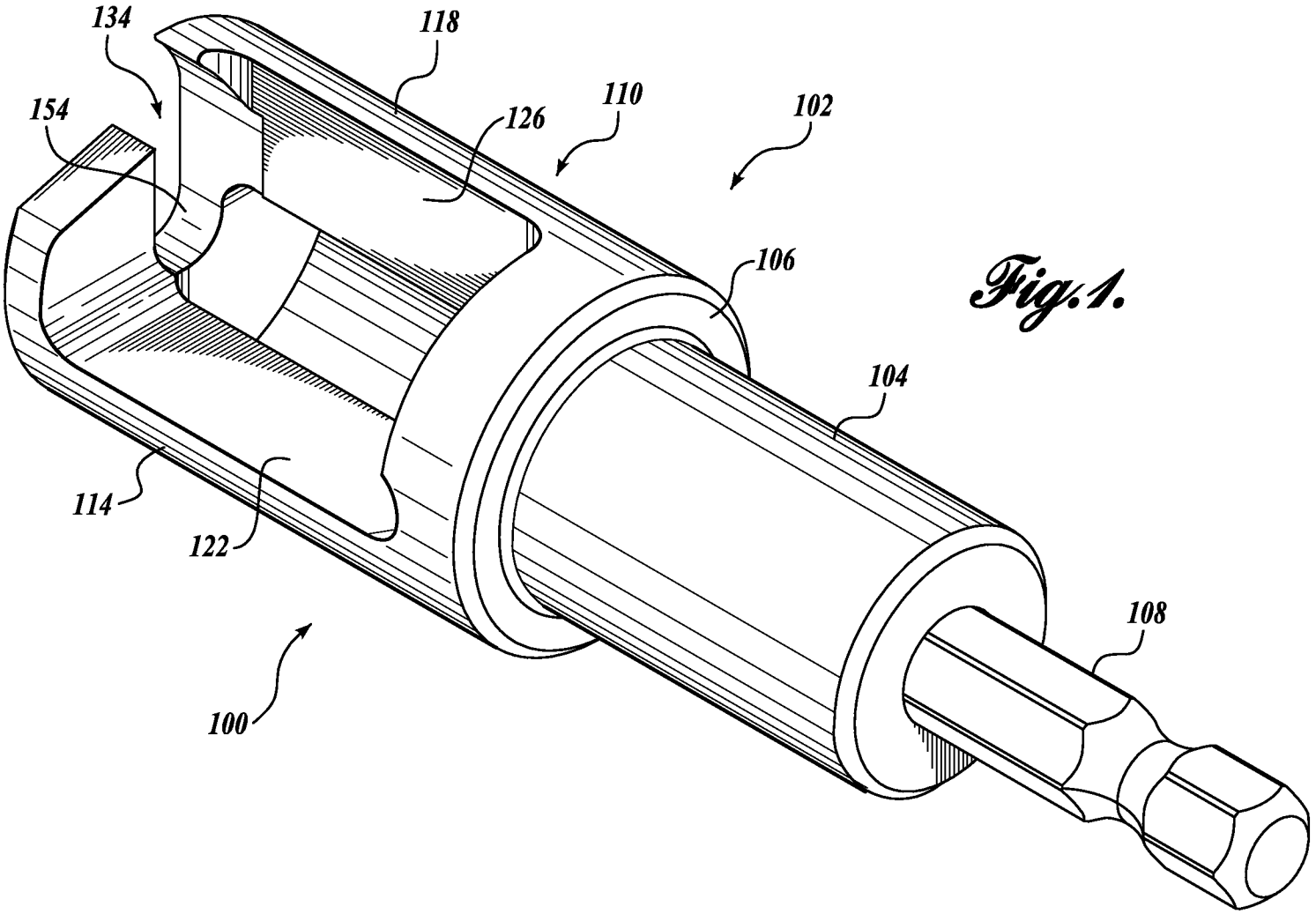
FIG. 1 is a front isometric view of a lag driver formed in accordance with aspects of the present disclosure.

A lag driver 100 formed in accordance with a preferred embodiment of the present disclosure may best be seen by referring to FIG. 1. The lag driver 100 is generally configured to releasably receive a hook or eye fastener or similar fastener (see FIGS. 4A-4D) and drive the fastener into or out of a medium such as drywall, wood, etc. It should be appreciated that although the lag driver 100 is shown and described with respect to a hook or eye fastener, the lag driver 100 may instead be used with any other suitable fastener. Thus, the descriptions and illustrations herein should not be construed as limiting the scope of the claimed subject matter. Moreover, for ease of illustration and clarity, the lag driver 100 is mostly shown in a substantially horizontal orientation, although it may be suitably used in any orientation, such as vertical. Therefore, terminology, such as "front," "rear," "forward," "rearward," etc., should be construed as merely descriptive and not limiting. Further, although certain geometric shapes may be illustrated and described below, it should be understood that such terms are intended to be merely descriptive and not limiting. Hence, other geometric shapes, such as oval, round, square, etc., are also within the scope of the present disclosure.

Figure 2:
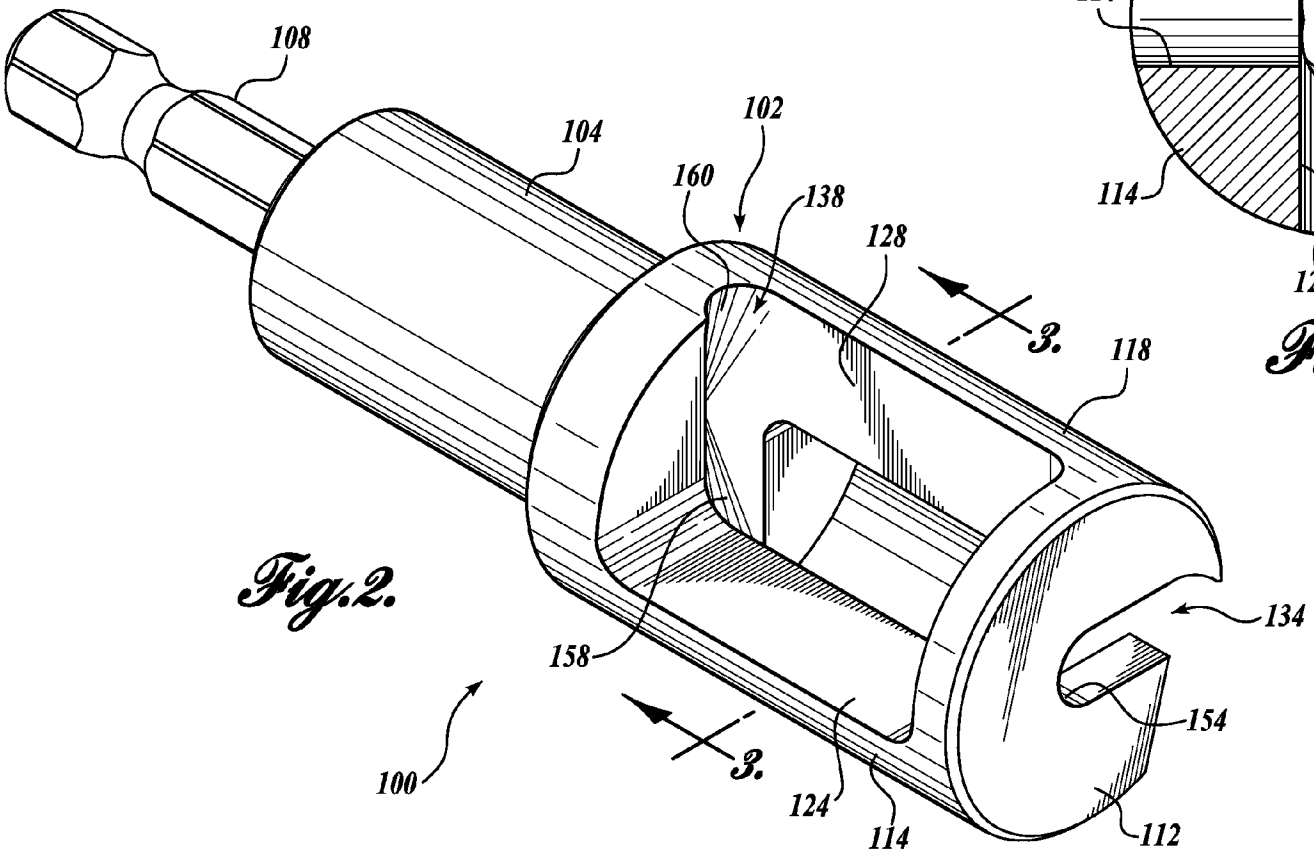
FIG. 2 is a rear isometric view of the lag driver of FIG. 1, wherein the lag driver is rotated about its axis ninety degrees.

Referring to FIGS. 1 and 2, the components of the lag driver 100 will now be described in detail. The lag driver 100 generally includes a tool attachment shank or drive shank 108 extending coaxially from a drive body assembly 102. The drive shank 108 is made from a suitable material well known in the art and is suitably sized and shaped to be received and retained within a receptacle or chuck of any standard hand drill, screwdriver, or similar tool that is equipped with the means to drive the shank 108. For instance, the drive shank 108 may be hex shaped or any other suitable polygonal shape, circular, or any other suitable shape that is configured to be received within a correspondingly shaped chuck of a drill.

The drive body assembly 102 includes a drive body 104 integrally formed with or otherwise secured to the drive shank 108. The drive body 104 is made from a suitable material well known in the art, such as a suitable metal, and it is any suitable size and configuration, such as cylindrical, rectangular, etc. In the depicted embodiment, the drive body 104 is cylindrical such that it is easily graspable by a user when in use. Moreover, the cylindrical drive body 104 has a substantially circular cross-section such that the drive body 104 may easily rotate within a user's grasp when using the lag driver 100 to drive a fastener into or out of a medium.

The drive body assembly 102 further includes a fastener-receiving body 110 extending from the drive body 104 that is generally configured to releasably receive a hook or eye fastener or similar fastener and drive the fastener into or out of a medium such as drywall, wood, etc. In the embodiment illustrated in FIGS. 4A-4D, the fastener-receiving body 110 is configured for use with an eye fastener 142 having an eye portion 146 formed at one end, a shaft 148 extending from the eye portion 146, and a threaded end 150 formed on the shaft 148 opposite the eye portion 146. As noted above, the lag driver 100 may instead be used with a hook fastener or any other suitable fastener. Thus, the description of the lag driver 100 with reference to an eye fastener 142 is for illustrative purposed only.

The fastener-receiving body 110 is integrally formed with or otherwise secured to the drive body 104 opposite the drive shank 108. The fastener-receiving body 110 is any suitable overall shape, such as cylindrical, and it has any suitable cross-sectional size to accommodate fasteners of various shapes and sizes. In the depicted embodiment, the fastener-receiving body 110 is also slightly larger in cross-sectional size than the drive body 104, thereby defining an annular shoulder 106 transverse to the longitudinal axis of the drive body 104 at the intersection of the fastener-receiving body 110 and the drive body 104. As such, a user may press against the annular shoulder 106 to help stabilize the lag driver 100 when driving a fastener into a medium.

The fastener-receiving body 110 also defines a substantially flat transverse end surface 112 opposite the drive body 104 that is engageable with a medium, when driving a fastener into the medium. The end surface 112 helps to appropriately position the depth of the fastener within the medium by limiting the axial movement of the lag driver 100 toward the medium.

The fastener-receiving body 110 is defined by first and second drive pillars 114 and 118 configured to releasably receive a hook or eye fastener and drive the fastener into or out of a medium. The drive pillars 114 and 118 extend axially between a first end of the fastener-receiving body 110 near the annular shoulder 106 and a second end of the fastener-receiving body 110 near the transverse end surface 112.

Figure 3:
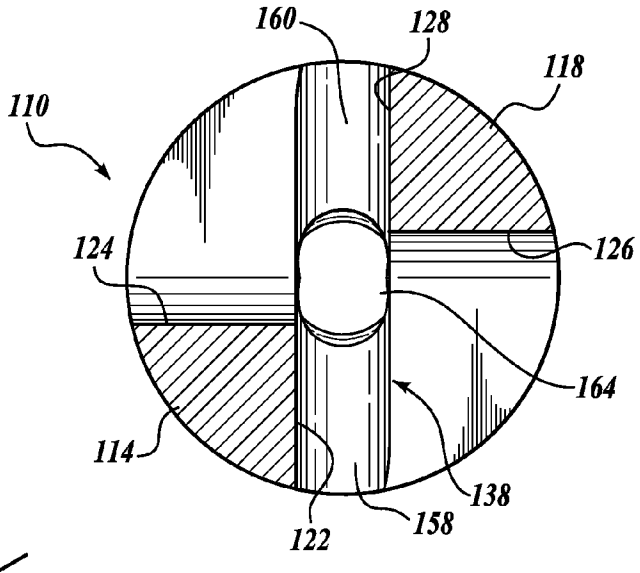
FIG. 3 is a cross sectional view of the lag driver of shown in FIG. 2, taken substantially across line 3-3.

As may best be seen by referring to FIG. 3, the first drive pillar 114 is defined by a first drive surface 122 and a first load surface 124 extending inwardly from the exterior cylindrical surface of the fastener-receiving body 110. The first drive surface 122 and the first load surface 124 define an angle therebetween that may be any suitable any, such as ninety degrees (90°). Similarly, the second drive pillar 118 is defined by a second drive surface 128 and a second load surface 126 extending inwardly from the exterior cylindrical surface of the fastener-receiving body 110. The second drive surface 128 and the second load surface 126 define an angle therebetween that may be any suitable any, such as ninety degrees (90°).

Although the first drive surface 122, the first load surface 124, the second drive surface 128, and the second load surface 126 may be any suitable contour, in the depicted embodiment, the surfaces are flat such that the first drive surface 122 is substantially transverse to the first load surface 124, and the second drive surface 128 is substantially transverse to the second load surface 126. In that regard, the first and second drive surfaces 122 and 128 are spaced in a substantially parallel relationship to one another, and the first and second load surfaces 124 and 126 are spaced in a substantially parallel relationship to one another. The predetermined gap or distance between the first and second drive surfaces 122 and 128 and the first and second load surfaces 124 and 126 is sufficient to receive a portion of the fastener, such as the eye portion 146 of eye fastener 142, therebetween (see FIGS. 4B and 4C).

As can be seen by referring additionally to FIGS. 4A-4D, with the eye portion 146 received between either the first and second drive surfaces 122 and 128 or the first and second load surfaces 124 and 126 (or at some rotated, loading position therebetween), the shaft 148 protrudes from a first slot 134 defined in the transverse end surface 112 of the fastener-receiving body 110. The first slot 134 is sized and configured to receive the shaft 148 of fastener 142 and retain the shaft 148 in coaxial alignment with the center longitudinal axis of the fastener-receiving body 110.

More specifically, the first slot 134 extends radially from an outer cylindrical surface of the fastener-receiving body 110 toward the center longitudinal axis of the fastener-receiving body 110 and terminates in an axially aligning surface 154. The axially aligning surface 154 is formed within the first slot 134 at a specified radial distance from the outer cylindrical surface to position the shaft 148 of the eye fastener 142 in substantial axial alignment with center longitudinal axis of the fastener-receiving body 110 when received therein.

Figure 4A:
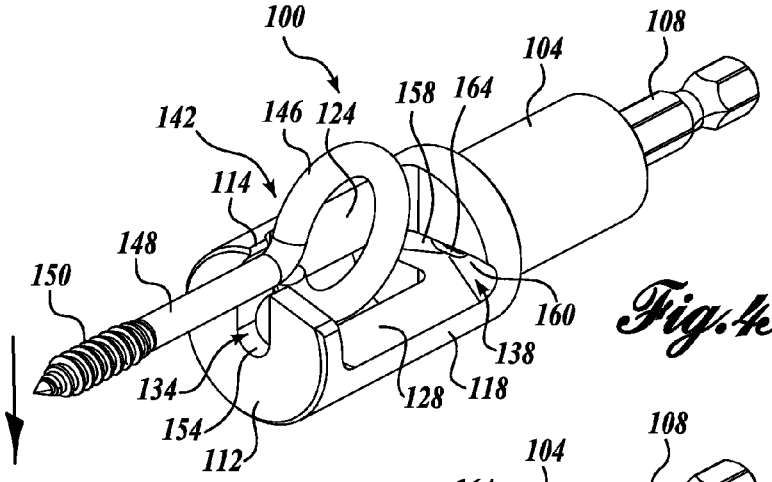
FIG. 4A is a front isometric view of the lag driver of FIG. 1, wherein a fastener is shown engaged with the lag driver in a first position.
Figure 4B:
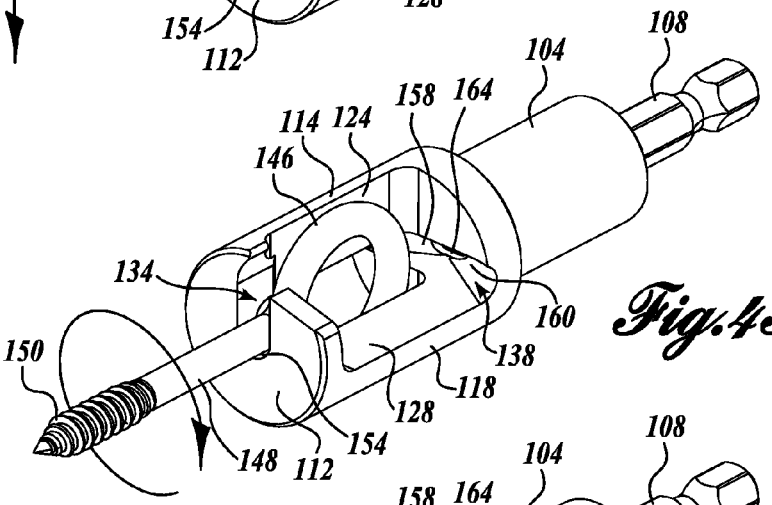
FIG. 4B is a front isometric view of the lag driver of FIG. 1, wherein a fastener is shown engaged with the lag driver in a second position.

The width of the first slot 134 is defined by first and second slot surfaces (not labeled) extending radially inwardly from the outer cylindrical surface of the fastener-receiving body 110. The first and second slot surfaces are substantially coplanar with the first and second load surfaces 124 and 126 of the first and second drive pillars 114 and 118 so that the width of the first slot 134 is substantially equal to the predetermined distance between the first and second load surfaces. As such, the eye fastener 142 may be loaded into the fastener-receiving body 110 by disposing the eye portion 146 between the first and second load surfaces 124 and 126 and by disposing the shaft 148 within the first slot 134, as shown in FIGS. 4A and 4B. In that regard, the first and second load surfaces 124 and 126 assist in guiding and loading the eye fastener 142 into engagement with the fastener-receiving body 110.

A second slot 138 is defined within the end of the fastener-receiving body 110 near the annular shoulder 106 for receiving and securing the eye portion 146 of the fastener 142 within the fastener-receiving body 110 in a locked, drive position (see FIG. 4D) rotated ninety degrees from the loading position described above (see FIGS. 4A and 4B). The second slot 138 extends across the fastener-receiving body 110 between opposite cylindrical exterior surfaces of the fastener-receiving body 110 and is substantially transverse to the first slot 134.

The second slot 138 is sized and configured to receive part of the eye portion 146 of the eye fastener 142 when the eye portion 146 is positioned between the first and second drive surfaces 122 and 128 of the first and second drive pillars 114 and 118. In that regard, the width of the second slot 138 is substantially equal to the predetermined distance between the first and second drive surfaces 122 and 128 of the first and second drive pillars 114 and 118.

To help secure the eye portion 146 within the second slot 138 and maintain the eye fastener 142 in substantial coaxial alignment with the fastener-receiving body 110, the second slot 138 includes first and second slanted surfaces 158 and 160 to define an overall substantially "V" shape. As such, the curved eye portion 146 of the eye fastener 142 may be seated and substantially centered within the second slot 138. It should be appreciated that the second slot 138 may instead be generally concave in shape or any other suitable shape to receive the head portion of the eye fastener 142 or various other fasteners.

A retaining member may also be disposed within the second slot 138 to help retain the eye portion 146 within the second slot 138. For instance, the retaining member may be a magnet 164 disposed at the apex of the V-shaped second slot 138 between the first and second slanted surfaces 158 and 160. The magnet 164 releasably locks the eye portion 146 of the eye fastener 142 within the second slot 138. It should be appreciated that any other suitable retaining member may instead be used. For instance, a C-shaped spring clip (not illustrated) may instead be disposed within the second slot 138 for releasably locking the eye portion 146 within the second slot 138.

As noted above, the eye portion 146 of the eye fastener 142 is securable within the second slot 138 when the eye portion 146 is positioned between the first and second drive surfaces 122 and 128 of the first and second drive pillars 114 and 118. In this locked, drive position, the sidewall surfaces of the second slot 138 and the first and second drive surfaces 122 and 128 of the drive pillars 114 and 118 are positioned to impose a torque on the eye portion 146 when the lag drive 100 is rotated. Moreover, the first and second drive surfaces 122 and 128, in combination with the first and second slots 134 and 138, are positioned to engage the eye fastener 142 to help maintain the coaxial alignment of the eye fastener 142 within the fastener-receiving body 110. The eye fastener 142 is essentially confined within the fastener-receiving body 110 such that the eye fastener 142 will remain in coaxial alignment with the lag driver 100 and the driving mechanism (such as a chuck of a hand drill) when being driving into or out of a medium.

It should be appreciated that although the fastener-receiving body 110 is described as having a specific shape and configuration to appropriately position the eye fastener 142 in coaxial alignment with the lag driver 100 and impose a torque on the eye fastener 142, variations in shapes and configurations of the fastener-receiving body 110 may be appreciated by one of ordinary skill in the art. Thus, the foregoing description and illustrations herein should not be construed as limiting the scope of the claimed subject matter.

Referring to FIGS. 4A-4D, the operation of the lag driver 100 will now be described in detail. Referring specifically to FIGS. 4A and 4B, the eye fastener 142 is loaded into the fastener-receiving body 110 by disposing the eye portion 146 between the first and second load surfaces 124 and 126 of the first and second drive pillars 114 and 118. At the same time or thereafter, the shaft 148 of the eye fastener 142 may be disposed within the first slot 134 until the shaft 148 engages the bottom of the slot or the axially aligning surface 154. In this initial loading position, as shown in FIG. 4B, the shaft 148 of the fastener is in substantial coaxial alignment with the fastener-receiving body 110 (and therefore, the lag driver 100).

Figure 4C:
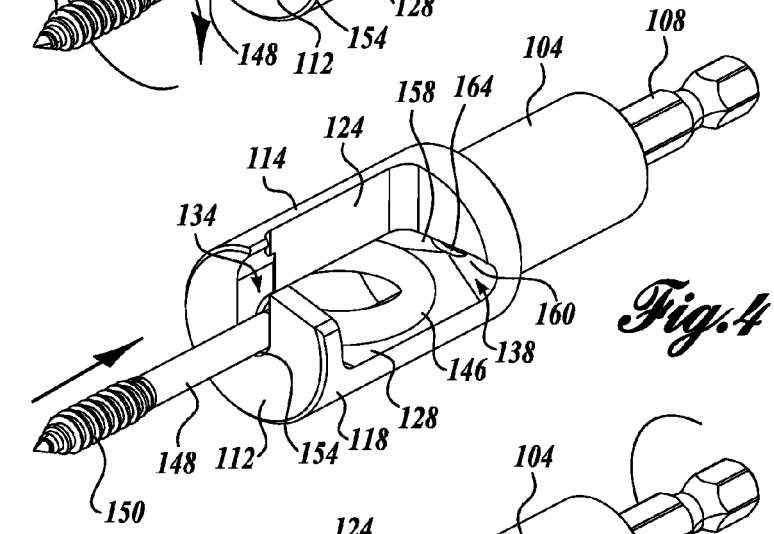
FIG. 4C is a front isometric view of the lag driver of FIG. 1, wherein a fastener is shown engaged with the lag driver in a third position.
Figure 4D:
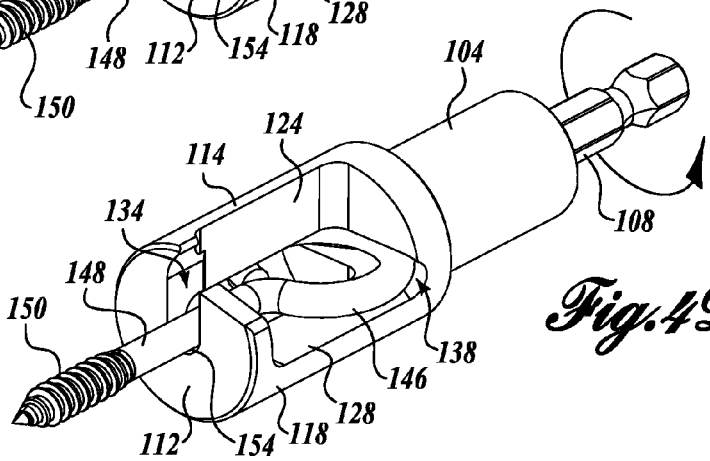
FIG. 4D is a front isometric view of the lag driver of FIG. 1, wherein a fastener is shown engaged with the lag driver in a fourth position.

Referring to FIGS. 4B and 4C, the eye fastener 142 is rotated clockwise about its longitudinal axis until the eye portion 146 is disposed between the first and second drive surfaces 122 and 128 of the first and second drive pillars 114 and 118. The eye fastener 142 is then slid axially into the second slot 138. The magnet 164 may be of a sufficient strength such that the eye portion 146 is urged into and retained within the second slot 138. With the eye fastener 142 disposed within the fastener-receiving body 110 in this locked, drive position, as shown in FIG. 4D, the eye fastener 142 may be both retained in its coaxial position within the fastener-receiving body 110 and driven by the fastener-receiving body 110 into or out of a medium. Specifically, the sidewall surfaces of the second slot 138 and the first and second drive surfaces 122 and 128 of the drive pillars 114 and 118 impose a torque on the eye portion 146 when the lag drive 100 is rotated.

The eye fastener 142 may be removed from the fastener-receiving body 110 by reversing the above-described steps. In particular, the eye fastener 142 may be removed by pulling the eye fastener 142 outwardly away from the second slot 138, rotating the eye fastener 142 ninety degrees, and removing the eye fastener from its position between the first and second load surfaces 124 and 126 and within the first slot 134.

It should be appreciated that the above-described steps for loading and unloading the eye fastener 142 are illustrative only, and the steps may instead be carried out in any suitable order and manner and/or in any suitable combination of steps.

As can be seen in FIGS. 4A-4D, the threaded portion 150 of the eye fastener 142 spirals to define a self-starting screw tip in coaxial alignment with the fastener shaft 148. As such, the user may simply engage the tip of the eye fastener 142 with the medium (such as a wall, ceiling, etc.) to drive the eye fastener 142 into the medium without the need for a pre-drilled screw hole. Thus, the lag driver 100 enables efficient, simple drive operation by maintaining the eye fastener 142 in coaxial alignment with the lag driver 100 during operation. However, it should be appreciated that the lag driver 100 may also be used with fasteners or substrates (such as wood, composites, etc.) requiring a pre-drilled screw hole.

The lag driver 100 provides a tool for safely, efficiently, and accurately installing a hook or eye fastener within a medium. While illustrative embodiments have been illustrated and described, it will be appreciated that various changes can be made therein without departing from the spirit and scope of the invention.

The embodiments of the present disclosure in which an exclusive property or privilege is claimed are defined as follows:

1. A lag driver, comprising:

(a) a drive shank having a longitudinal axis; and (b) a drive body assembly extending from the drive shank, the drive body assembly having a fastener-receiving body with first and second drive pillars extending axially along a portion of the drive body assembly, the first drive pillar having a first drive surface and a first load surface, the second drive pillar having a second drive surface and a second load surface, wherein the first and second drive surfaces are in a spaced substantially parallel relationship to one another to define a first predetermined gap between the first and second drive surfaces, the first predetermined gap having a gap width, wherein the first and second load surfaces are in a spaced substantially parallel relationship to one another to define a second predetermined gap between the first and second load surfaces, the first drive surface positioned in a fixed, substantially transverse relationship to the first load surface and the second drive surface positioned in a fixed, substantially transverse relationship to the second load surface, wherein a fastener is disposable in the second predetermined gap such that it is engageable with the first load surface of the first drive pillar and the second load surface of the second drive pillar in a loading position, and wherein in the loading position the fastener is positionable in substantial coaxial alignment with the lag driver, and wherein the fastener is rotatable into the first predetermined gap in a locked position, the first and second drive surfaces engageable with a portion of the fastener in the locked position when the drive shank is moved about its longitudinal axis in a first direction for applying torque to the fastener, and further comprising a first slot formed in the fastener-receiving body opposite the drive shank, the first slot in substantial alignment with the first predetermined gap and having a slot width that is substantially equal to the gap width of the first predetermined gap, the first slot configured to removably receive the portion of the fastener and position the portion of the fastener in substantial coaxial alignment with the lag driver.

2. The lag driver of claim 1, wherein the width of the first slot is defined by first and second slot surfaces that are substantially coplanar with the first and second load surfaces of the first and second drive pillars.

3. The lag driver of claim 1, wherein the fastener is rotatable ninety degrees between the loading and locked positions.

4. The lag driver of claim 2, further comprising a retaining member configured to releasably secure the fastener within the fastener-receiving body.

5. The lag driver of claim 4, wherein the retaining member is disposed in the second slot that is substantially transverse to the first slot.

* * * * *